US006821405B1

(12) United States Patent
Marttila

(10) Patent No.: US 6,821,405 B1
(45) Date of Patent: Nov. 23, 2004

(54) DEVICE FOR CONVEYING ELECTRODES USED IN THE ELECTROLYTIC REFINING OR ELECTROWINNING OF METALS

(75) Inventor: Tom Marttila, Verkkokuja (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/979,970

(22) PCT Filed: May 19, 2000

(86) PCT No.: PCT/FI00/00455

§ 371 (c)(1),
(2), (4) Date: Nov. 27, 2001

(87) PCT Pub. No.: WO00/77276

PCT Pub. Date: Dec. 21, 2000

(30) Foreign Application Priority Data

Jun. 10, 1999 (FI) ..... 991324

(51) Int. Cl.[7] ..... C25C 7/06

(52) U.S. Cl. ..... 205/137; 204/198; 204/222; 204/225; 198/465.4; 198/468.6; 414/749.1

(58) Field of Search ..... 204/198, 222, 204/225; 198/678.1, 717, 465.4, 468.675, 750.1, 772; 414/749.1, 749.4; 205/137

(56) References Cited

U.S. PATENT DOCUMENTS

| | | | | |
|---|---|---|---|---|
| 3,707,764 A | * | 1/1973 | Frankovich | 29/527.6 |
| 3,715,048 A | | 2/1973 | Raab | 414/626 |
| 3,938,672 A | | 2/1976 | Leiponen et al. | 414/729 |
| 3,946,854 A | * | 3/1976 | Kojima et al. | 198/431 |
| 4,028,211 A | * | 6/1977 | Hirakawa et al. | 204/267 |
| 4,217,919 A | * | 8/1980 | Faunce et al. | 134/133 |
| 4,363,395 A | | 12/1982 | Mink | 198/773 |
| 6,202,830 B1 | | 3/2001 | Bohlin et al. | 198/465.1 |

FOREIGN PATENT DOCUMENTS

WO WO 9724475 A1 * 7/1997 ..... C25C/7/06

* cited by examiner

*Primary Examiner*—Nam Nguyen
*Assistant Examiner*—Brian L. Mutschler
(74) *Attorney, Agent, or Firm*—Smith-Hill and Bedell

(57) ABSTRACT

The invention relates to a device for conveying electrodes, used in the electrolytic refining or electrowinning of metals, from one station to another, particularly when the electrodes are conveyed in an essentially perpendicular direction with respect to the line connecting the electrode support points. According to the invention, in order to convey an electrode, the device is provided with mutually separate members, at least one lift member for a vertical motion of the electrode and at least one conveyor member for the horizontal motion of the electrode.

13 Claims, 2 Drawing Sheets

DEVICE FOR CONVEYING ELECTRODES USED IN THE ELECTROLYTIC REFINING OR ELECTROWINNING OF METALS

BACKGROUND OF THE INVENTION

The present invention relates to a device for conveying electrodes used in the electrolytic refining or electrowinning of metals from one station to another, in which device the number of movable parts and mechanisms is limited, and the spacing of the electrodes is maintained essentially the same.

In electrolytic plants used for producing metals, such as copper, nickel and zinc, there are processed remarkable amounts of electrodes, anodes and cathodes. Owing to the large quantities to be processed, the processing is mainly carried out with machines, where an important function is to convey the electrodes from one working step to another.

Traditionally, chain and walking beam conveyors are used for conveying electrodes. However, in this type of conveyors there arise problems that are partly caused by the electrolytic conditions and partly to the structural arrangements of the conveyors. Problems caused by the electrolytic conditions are generally connected to mechanical wearing due to impurities in the electrodes, and to corrosion due to the corroding effect of the electrolyte. Conveyor arrangements are normally difficult to protect against these conditions.

A common problem with chain conveyors is the stretching of the chain, which is further enhanced by the impurities and corrosion typical of electrolytic processes. This is a particularly remarkable problem in electrolytic machines, because the electrodes should, in each processing station along the conveyor line, be brought to precisely the correct position, which can only be done with a conveyor where the spacing between the electrodes always remains exactly right.

As for the structural arrangements of walking beam conveyors, there is generally used a structure where the element conveying electrodes, i.e. the walking beam, both rises up and performs a controlled horizontal shifting motion prior to descending and returning to the initial position. The lifting step, where the walking beam raises the electrodes to be conveyed so that they are supported by the walking beam, must—for functional reasons of the mechanism—be performed exactly in the same rhythm along the whole length of the walking beam, which makes the mechanism, particularly in long conveyors, heavy and complicated.

For all the above mentioned reasons, known conveyor arrangements are generally expensive, but still wear relatively rapidly and require a lot of maintenance.

SUMMARY OF THE INVENTION

The object of the present invention is to alleviate the drawbacks of the prior art and to achieve an improved device for conveying electrodes, used in the electrolytic refining or electrowinning of metals in an electrolytic plant, from one station to another, particularly when the electrodes are conveyed in the length-wise direction, i.e. in an essentially perpendicular direction with respect to the line connecting the electrode support points. The essential novel features of the invention are apparent from the appended claims.

According to the invention, in an electrode conveyor device to be used for electrolytic refining or electrowinning in an electrolytic plant, the horizontal conveying motion proper, and the lifting motion required by the walking beam principle are assigned for separate members. For performing the conveying motion, the conveyor comprises at least one conveyor member, and for the lifting motion, at least one lift member. Advantageously the conveyor device according to the invention comprises two conveyor members and respectively two lift members. Moreover, the conveyor device according to the invention usually has a modular structure, in which case one module is formed by two conveyor members and respectively by two lift members. When employing a pair of conveyor members and respectively a pair of lift members, the electrode to be conveyed is advantageously supported at both ends of the supporting structures of the electrode.

In a conveyor device according to the invention, the conveyor member is formed of an essentially rail-like structure, which is advantageously installed underneath the electrode supporting structures, such as cathode hangers and anode support lugs, so that the conveyor member is movable back and forth, essentially for the length of the electrode conveying step only, in an essentially horizontal direction.

In a conveyor device according to the invention, the lift member is formed of a lift plate, which also is installed advantageously underneath the electrode supporting structures, such as cathode hangers and anode support lugs, so that the lift member is movable back and forth essentially for the length caused by a possible indentation of the conveyor member and the lift member only. The lift member is essentially movable in the vertical direction only, when said lift member is supported so that the motion as such is not linear.

Advantageously the conveyor device according to the invention is formed of one or several modules, each module advantageously comprising a pair of conveyor members and a pair of lift members supported against the module housing structure. Moreover, in between the module housing structure and the essentially horizontally movable conveyor members on one hand, and the essentially vertically movable lift members on the other hand, in the module there are installed support members creating the desired motion, such as roller support and control, slide rail support and control, or a combination of these. The back and forth motion of the conveyor and lift members is advantageously generated by hydraulic cylinders, but other types of drive elements can also be used for creating the motion, such as pneumatic or electric drive elements.

The operation of a conveyor device according to the invention is based on the following steps:

1) the lift member lowers the electrode down, to rest supported by the conveyor member,
2) the conveyor member conveys the electrode for the length of a desired horizontal step,
3) the lift member lifts the electrode up from the support of the conveyor member, and
4) the conveyor member returns, without the load, to the initial position in order to start a new cycle.

In the conveyor member according to the invention, the essentially horizontal conveying motion proper and the lifting motion required by the walking beam principle are performed by separate members, and therefore the structure of the conveyor device allows for the conveyor members to move separately at different times or in a different rhythm, the lift members to move separately at different times or in a different rhythm and even the ends of each lift member to move separately at different times or in a different rhythm, in case in between the above described operational steps, it is observed that all motions of the preceding step are performed. In particular the fact that the operation of the conveyor device according to the invention allows for the lift members to move separately at different times or in a different rhythm and even the ends of each lift member to move separately at different times or in a different rhythm makes the module of the conveyor device according to the invention essentially simpler than the traditional walking beam conveyors.

The modular structure of the conveyor device according to the invention is made particularly advantageous by the fact that because the weight of the electrodes, cathodes or anodes, in each electrode type is essentially constant, in the module essentially only the housing width and height are chosen according to the measures of the electrode in question. In case a single module structure becomes essentially long, said module structure can be combined of several successive modules. The modules can be placed in succession essentially without mechanical coupling. In the case of more than one module, the modules can advantageously be controlled in the same fashion as one single module, i.e. for example all actuators of the lift members and all actuators of the conveyor members can be mutually connected to be under one and the same control. When necessary, also the conveyor members of successive modules can be mechanically connected. In similar fashion, it may be advantageous, from the point of view of the installation and use of the conveyor device, that at least the housings of successive modules are mechanically connected, for instance by means of a bolted joint.

When using the conveyor device according to the invention, the spacing of the electrodes always remains essentially constant. Because the horizontal and vertical motions are separated for their specific members, the actuators as such are simple, and mechanical synchronisation between the motions is not necessary. Consequently, the structure is economical in manufacturing expenses, and the maintenance needed by the structure is minimal. Also the number of movable parts and mechanisms in the conveyor device is essentially small, in which case the structure becomes strong and has a long working life.

BRIEF DESCRIPTION OF THE DRAWINGS

The invention is described in more detail below, with reference to the accompanying drawings, where.

DETAILED DESCRIPTION OF THE INVENTION

Figure 1:
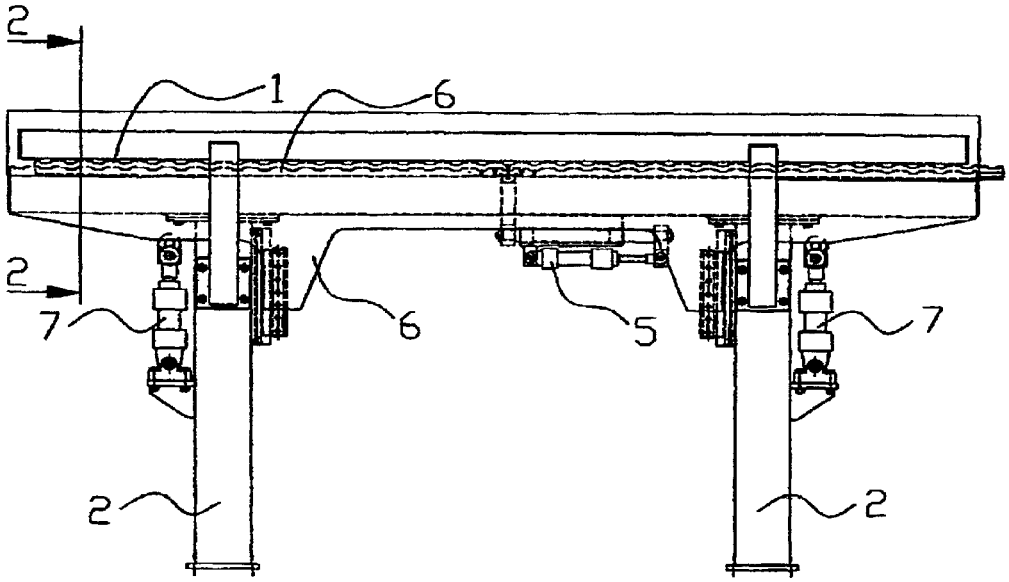
FIG. 1 illustrates a preferred embodiment according to the invention, seen from the side as an electrode is being conveyed.
Figure 2:
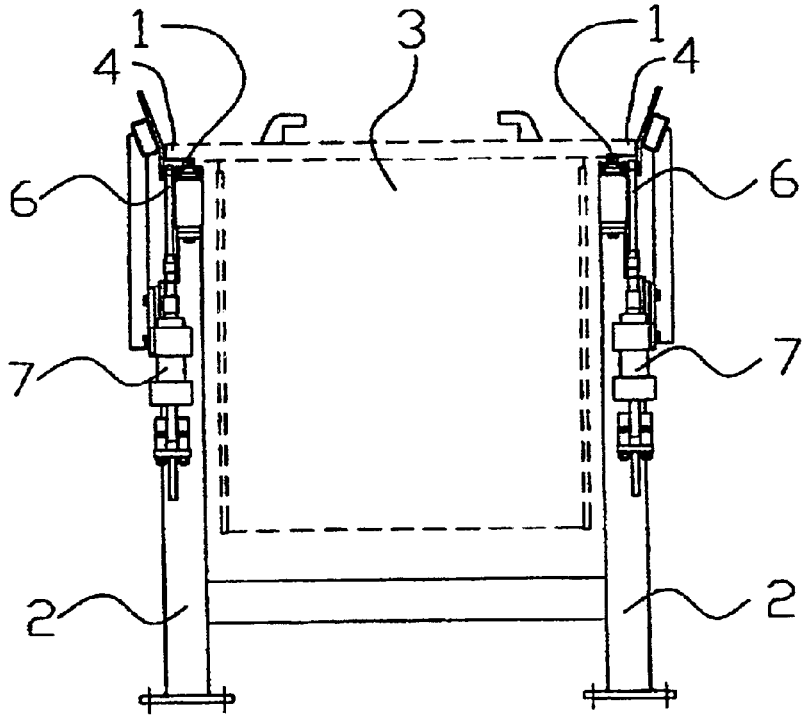
FIG. 2 illustrates the embodiment according to FIG. 1, seen from the direction 2—2.

According to the drawings, the conveyor member 1 is supported by the housing structure 2 of the conveyor device. The cathode 3 to be conveyed is supported, at the ends of the hanger 4, by a conveyor member 1, which is moved by a horizontally operating hydraulic cylinder 5. The cathode 3 is lowered to be supported by the conveyor device 1 by means of a lift member 6 installed in the same housing structure 2, and said lift member 6 is moved by vertically operated hydraulic cylinders 7.

What is claimed is:

1. A device for conveying an electrode in an electrolytic refining or electrowinning process, comprising:

a lift member that is operable for alternately raising the electrode from a lower level to an upper level and lowering the electrode from the upper level to the lower level, an elongate conveyor member supported for longitudinal movement relative to the lift member in first and second opposite horizontal directions, the conveyor member being positioned so that when the lift member lowers the electrode to the lower level, the lift member deposits the electrode on the conveyor member and longitudinal movement of the conveyor member is accompanied by movement of the electrode, and when the lift member raises the electrode to the upper level, the electrode is lifted from the conveyor member and longitudinal movement of the conveyor member is relative to the electrode, and a means for alternately moving the conveyor member in the first direction when the electrode is at the lower level and in the second direction when the electrode is at the upper level, whereby the electrode is conveyed stepwise in the first direction.

2. A device according to claim 1, for conveying an electrode having two support elements at opposite respective ends of an upper edge of the electrode, wherein the elongate conveyor member comprises two parallel elongate rails and the lift member comprises two parallel lift plates disposed adjacent the elongate rails respectively, whereby the electrode can be positioned between the two parallel lift plates and between the two parallel rails with the upper edge of the electrode substantially perpendicular to the two parallel rails and with the support elements of the electrode resting on the two rails respectively when the electrode is at the lower level and with the support elements resting on the two lift plates respectively when the electrode is at the upper level.

3. A device according to claim 2, wherein each of said elongate rails has an upper surface formed with recesses for locating said support elements.

4. A device according to claim 2, wherein each of said lift plates has an upper surface formed with recesses for locating said support elements.

5. A device according to claim 1, comprising a hydraulic or pneumatic cylinder means for alternately raising and lowering the lift member.

6. A device according to claim 1, comprising an electrical means for alternately raising and lowering the lift member.

7. A device according to claim 1, wherein said means for moving the conveyor member comprises a hydraulic or pneumatic cylinder means.

8. A device according to claim 1, wherein said means for moving the conveyor member comprises an electrical means.

9. A conveyor for conveying an electrode in an electrolytic refining or electrowinning process, said conveyor comprising at least first and second conveyor modules and each conveyor module comprising:

a frame, a lift member that is operable for alternately raising the electrode relative to the frame from a lower level to an upper level and lowering the electrode relative to the frame from the upper level to the lower level, an elongate conveyor member supported for longitudinal movement relative to the lift member in first and second opposite horizontal directions, the conveyor member being positioned so that when the lift member lowers the electrode to the lower level, the lift member deposits the electrode on the conveyor member and longitudinal movement of the conveyor member is accompanied by movement of the electrode, and when the lift member raises the electrode to the upper level, longitudinal movement of the conveyor member is relative to the electrode, and a means for alternately moving the conveyor member relative to the frame in the first direction when the electrode is at the lower level and in the second direction when the electrode is at the upper level, whereby the electrode is conveyed stepwise in the first direction, and wherein the first and second conveyor modules are disposed in succession.

10. A conveyor according to claim 9, wherein the conveyor member of the first conveyor module is mechanically connected to the conveyor member of the second conveyor module.

11. A conveyor according to claim 9, comprising a control means for controlling operation of the lift members of the first and second conveyor modules.

12. A conveyor according to claim 9, comprising a control means for controlling the means for moving the conveyor means of the first conveyor module and the means for moving the conveyor means of the second conveyor module.

13. A method of conveying an electrode in an electrolytic refining or electrowinning process employing a lift member that is operable for alternately raising the electrode from a lower level to an upper level and lowering the electrode from the upper level to the lower level and an elongate conveyor member that is supported for longitudinal movement in first and second opposite horizontal directions relative to the lift member and is positioned so that when the lift member lowers the electrode to the lower level the lift member deposits the electrode on the conveyor member, said method comprising:

a. lowering the electrode from the upper level to the lower level whereby the electrode is a supported on the conveyor member, b. moving the conveyor member in the first direction, c. raising the electrode from the lower level to the upper level, whereby the electrode is lifted from the conveyor member, d. moving the conveyor member in the second direction, and e. repeating steps a–d.

* * * * *